US007621531B2

(12) United States Patent
Yang

(10) Patent No.: US 7,621,531 B2
(45) Date of Patent: Nov. 24, 2009

(54) MECHANISM FOR TREAT CHOOSING GAME SET

(76) Inventor: Yi-Chiang Yang, No. 57, Lane 257, Changnan Rd., Sec. 2, Changhwa (TW)

( * ) Notice: Subject to any disclaimer, the term of this patent is extended or adjusted under 35 U.S.C. 154(b) by 163 days.

(21) Appl. No.: 12/069,162

(22) Filed: Feb. 8, 2008

(65) Prior Publication Data

US 2009/0200737 A1 Aug. 13, 2009

(51) Int. Cl.
*A63F 9/00* (2006.01)

(52) U.S. Cl. ..... 273/142 R; 273/138.1; 273/138.2; 463/16

(58) Field of Classification Search ..... 273/138.1, 273/138.2, 142 R, 142 H, 142 HA, 280; 463/16
See application file for complete search history.

(56) References Cited

U.S. PATENT DOCUMENTS 3,841,637 A * 10/1974 Piazza et al. ..... 273/141 A
4,871,171 A * 10/1989 Rivero ..... 463/20
5,271,628 A * 12/1993 Okada ..... 273/448
6,139,017 A * 10/2000 Kawamura ..... 273/445

* cited by examiner

*Primary Examiner*—Benjamin H Layno
(74) *Attorney, Agent, or Firm*—Charles E. Baxley

(57) ABSTRACT

A mechanism for treat choosing game sets includes a choosing device including at least one treat received in a box and the at least one treat is connected to a plate made by magnetic material. A rotation disk connected with the plate via a magnetic member located therebetween. A rotation device includes a motor and a transmission device which is driven by the motor. The transmission device includes a shaft and a belt wheel driven by the motor, a belt connected between the belt wheel and the shaft. The magnetic member is connected to the shaft and magnetically connected to the plate. When the box in which the at least one treat is received is stopped by the player, the transmission device drives the rotation disk as usual while the magnetic member is rotated relative to the plate.

5 Claims, 6 Drawing Sheets

MECHANISM FOR TREAT CHOOSING GAME SET

FIELD OF THE INVENTION

The present invention relates to a mechanism for a treat choosing game set and the mechanism allows the rotation device to keep rotating while one of the treats is stopped by the players.

BACKGROUND OF THE INVENTION

A conventional treat choosing game set generally includes a rotation device which includes a motor cooperated with a transmission device to rotate many treats about a shaft, each treat such as a toy, is received in a box. Some of the players, especially children will hold the box and want to check the treat in the box. Once the box is held, the transmission device and the motor are sudden stopped and might damage the gears and the parts in the transmission device.

The present invention intends to provide a mechanism for a treat choosing game set wherein a magnetic member is used to play a clutch device so that when the box is held, the transmission device and the motor are operated as usual so as to protect the motor and the transmission device.

SUMMARY OF THE INVENTION

The present invention relates to a mechanism for treat choosing game sets and the mechanism comprises a choosing device including at least one treat and a plate made by magnetic material is connected with the at least one treat. A rotation disk includes a central hole and a plurality of connection tubes extend from a side of the rotation disk. The connection tubes are connected with the plate. A rotation device includes a motor and a transmission device which is driven by the motor. The transmission device includes a shaft and a belt wheel driven by the motor, a belt is connected between the belt wheel and the shaft. A magnetic member is connected to the shaft and extends through the central hole in the rotation disk and is magnetically connected to the plate.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
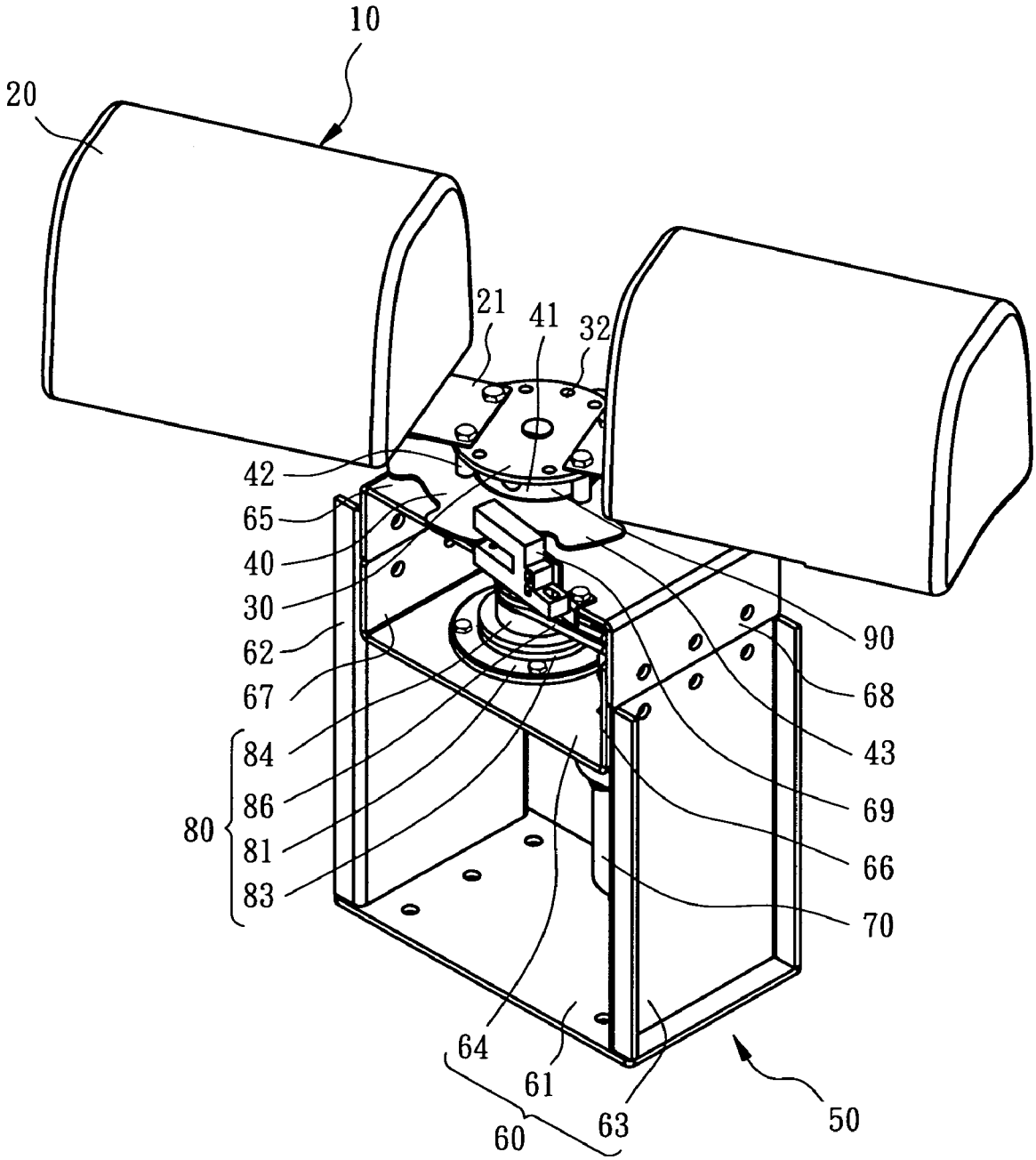
FIG. 1 is a perspective view to show the mechanism of the present invention.
Figure 2:
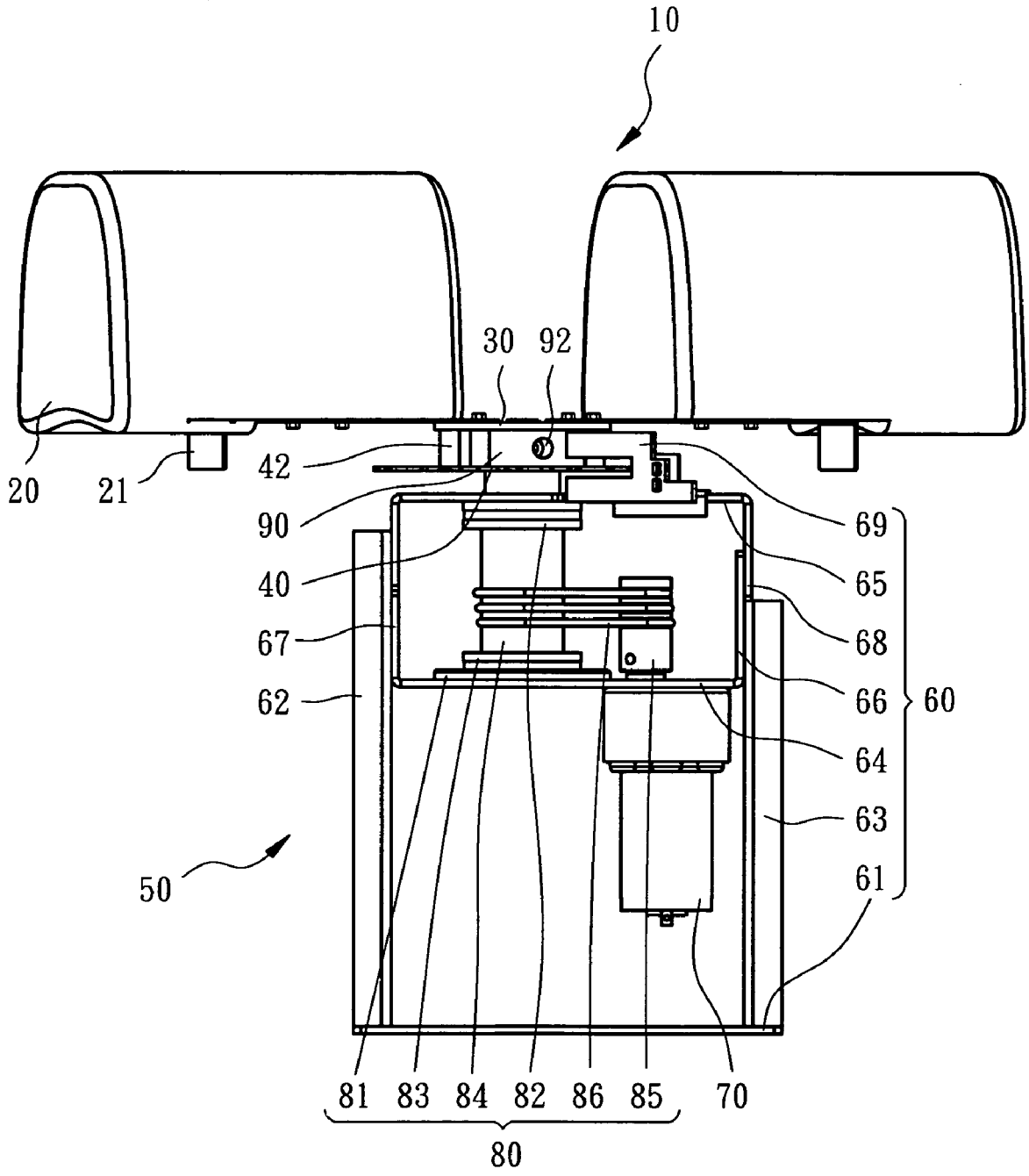
FIG. 2 is a side view to show the mechanism of the present invention.
Figure 3:
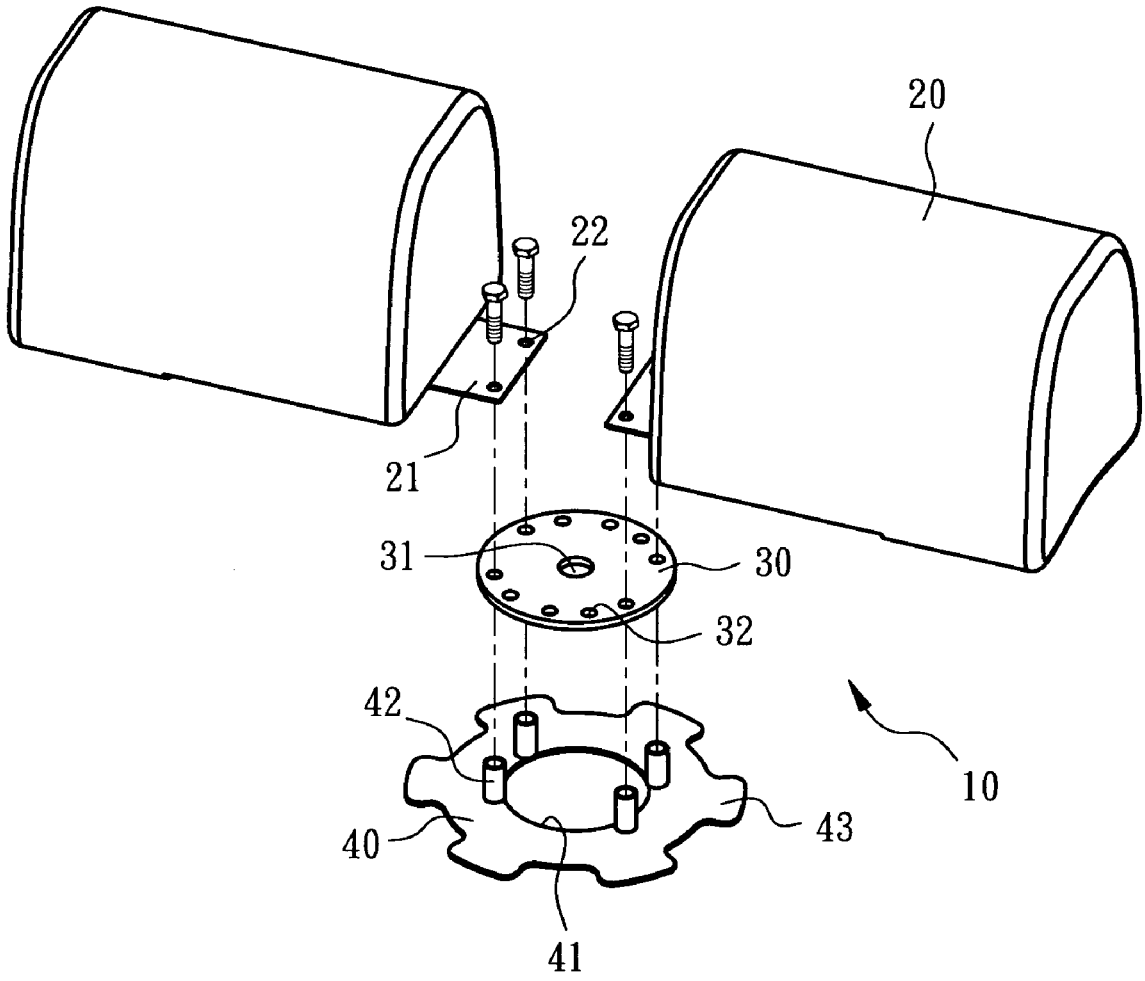
FIG. 3 is an exploded view to show the rotation disk, the plate and the two boxes to be connected to the plate.
Figure 4:
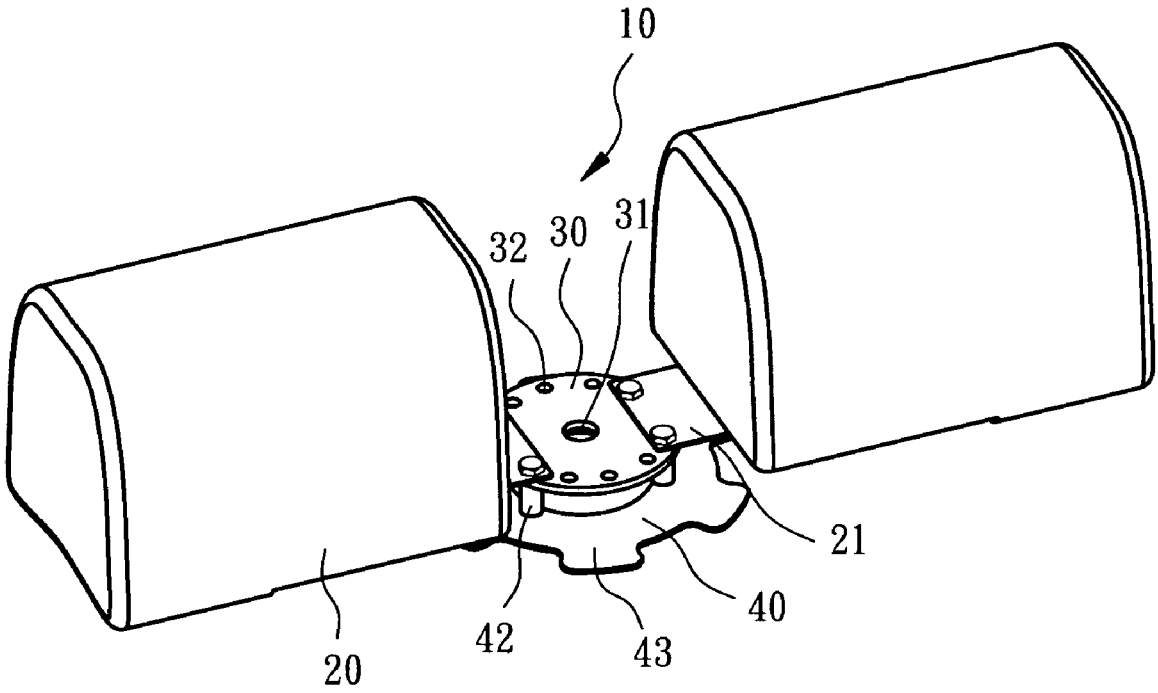
FIG. 4 is a perspective view to show the combination of the rotation disk, the plate and the two boxes connected to the plate.
Figure 5:
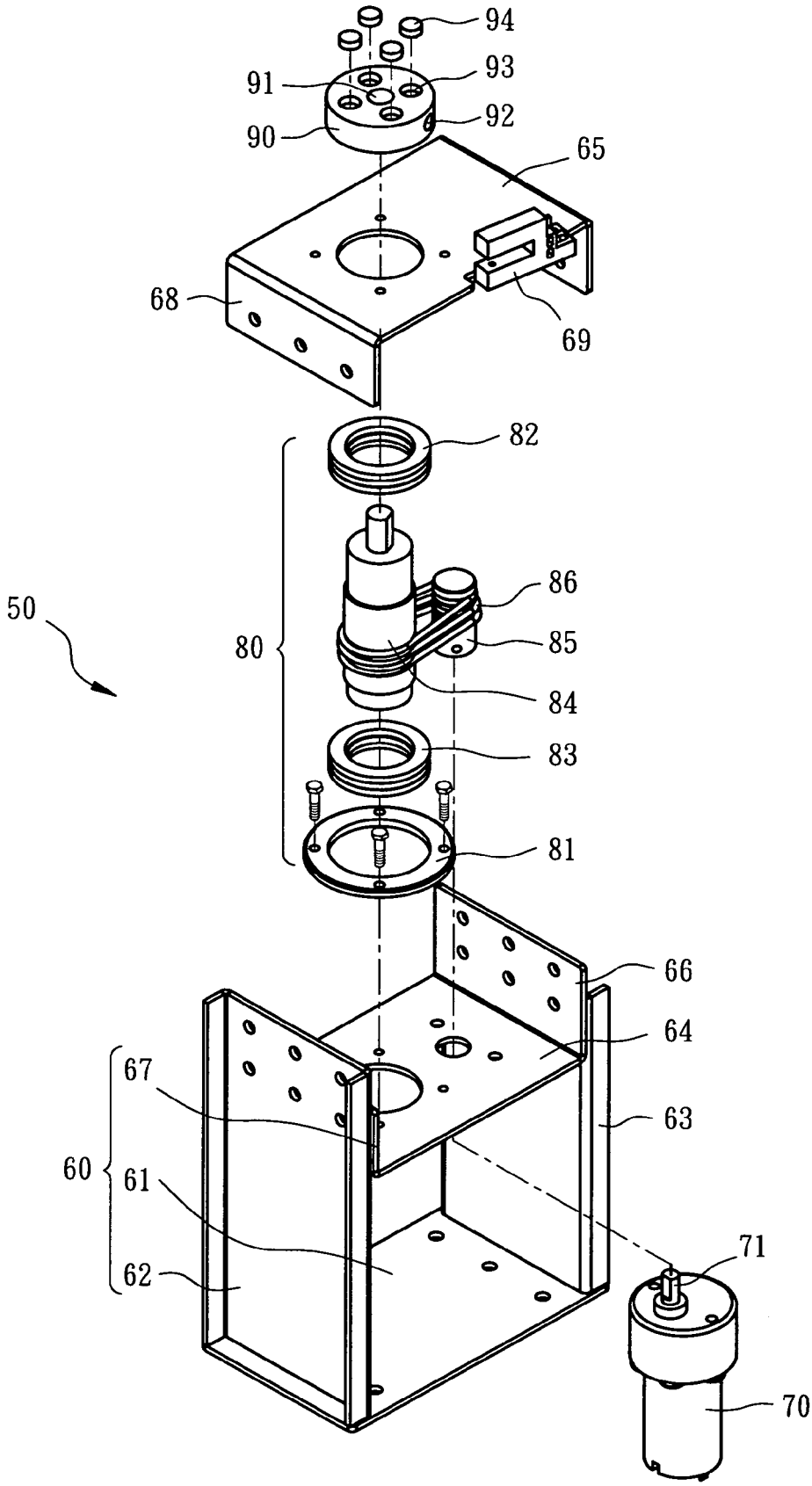
FIG. 5 is an exploded view to show the rotation device, the frame and the magnetic member of the present invention.
Figure 6:
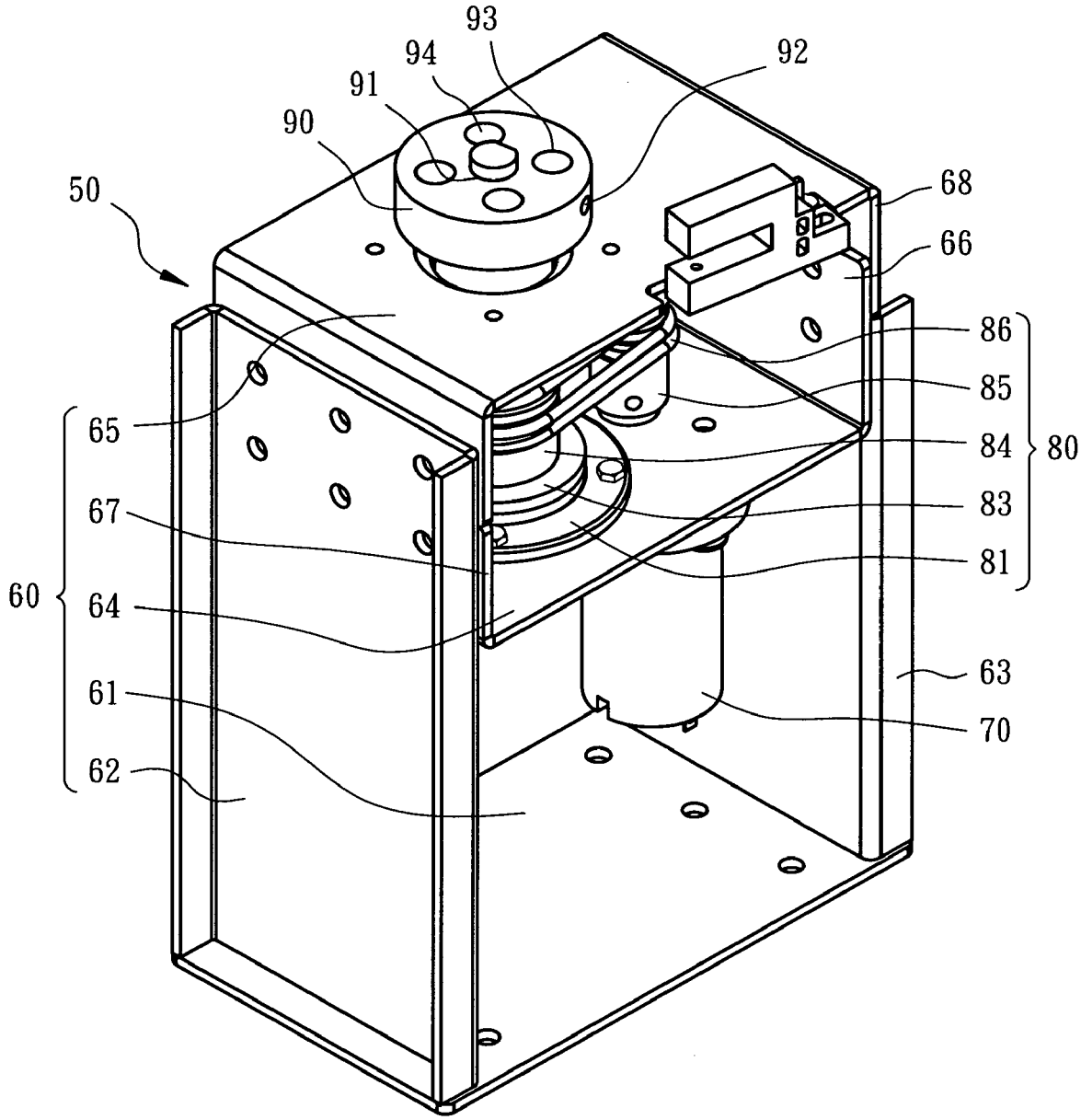
FIG. 6 is a perspective view to show the mechanism without the treats in the boxes, the rotation disk and the plate.

Referring to FIGS. 1 to 6, the mechanism for treat choosing game sets of the present invention comprises a choosing device 10 including two treats, for example, the treats can be a doll, a poppy head toy or any known item which is received in boxes 20. The two boxes 20 are located on two boards 21 and each board 21 includes two connection holes 22. A plate 30 made by magnetic material includes a central hole 31 and a plurality of positioning holes 32 which are located around the central hole 31. The boards 21 are connected to the plate 30 by extending bolts through the connection holes 22 of the boards 21 with the positioning holes 32 in the plate 30.

A rotation disk 40 includes a central hole 41 and a plurality of connection tubes 42 extend from a side of the rotation disk 40. The connection tubes 42 extend through the plate 30 and connected with connection holes 22 of the support board 21. The rotation disk 40 includes a plurality of protrusions 43 extending radially and outward therefrom.

A rotation device 50 includes a frame 60 which includes a bottom board 61, a first side panel 62 connected to one side of the bottom board 61, a second side panel 63 connected to the other side of the bottom board 61. The first side panel 62 is higher than the second side panel 63. A rack 64 has a short side 67 and a long side 66 extending two sides thereof, the long side 66 is fixed to the second side panel 63 and the short side 67 is fixed to the first side panel 62. A cover 65 has two folding sides 68 on two sides thereof which are rested on the short side 67 and fixed to the long side 66 respectively.

A motor 70 is secured to an underside of the rack 64 in the frame 60 and has a driving end 71 which extends through the rack 64. A transmission device 80 includes a shaft 84, a belt wheel 85 connected to the driving end 71 of the motor 70 and a belt 86 is connected between the belt wheel 85 and the shaft 84. A first bearing 82 and a second bearing 83 are respectively mounted to the shaft 84. A bearing frame 81 is fixed on the rack 64 and the second bearing 83 is rotatably engaged with the bearing frame 81 so that the shaft 84 is freely rotated relative to the bearing frame 81.

A magnetic member 90 has a central hole 91 and a radial hole 92 defined radially in a periphery of the magnetic member 90. The shaft 84 extends through the central hole 91 in the magnetic member 90 and a securing member extends into the radial hole 92 and contacts against the shaft 84, so that the magnetic member 90 is co-rotated with the shaft 84. Four recesses 93 are defined in a top of the magnetic member 90 and a magnet 94 received in each of the recesses 93. The magnetic member 90 extends through the central hole 41 in the rotation disk 40 and is magnetically connected to the plate 30. A detection device 69 is connected to the frame 60 and the protrusions 43 pass through the detection device 69.

When one of the boxes 20 is stopped or held by the player, the combination of the plate 30, the support boards 21 and the boxes 20 do not rotate, and because the resistance force that stops the boxes 20 is much larger than the magnetic force between the magnets 94 in the magnetic member and the plate 30, so that the magnetic member 90 is co-rotated with the shaft 84. By this way, the motor 70 and the parts in the transmission device 80 are protected.

While we have shown and described the embodiment in accordance with the present invention, it should be clear to those skilled in the art that further embodiments may be made without departing from the scope of the present invention.

What is claimed is:

1. A mechanism for treat choosing game sets, comprising:

a choosing device including at least one treat, a plate made by magnetic material connected with the at least one treat, a rotation disk including a central hole and a plurality of connection tubes extending from a side of the rotation disk, the connection tubes connected with the plate;

a rotation device including a motor and a transmission device which is driven by the motor, the transmission device including a shaft and a belt wheel driven by the motor, a belt connected between the belt wheel and the shaft, and a magnetic member connected to the shaft and extending through the central hole in the rotation disk and magnetically connected to the plate.

2. The mechanism as claimed in claim 1, wherein the at least one treat is received in a box.

3. The device as claimed in claim 2, wherein the box is connected to a support board which is connected to the plate.

4. A mechanism for treat choosing game sets, comprising:

a choosing device including at least one treat which is located on a support board, a plate made by magnetic material, a rotation disk including a central hole and a plurality of connection tubes extending from a side of the rotation disk, the connection tubes extending through the plate and connected with the support board, the rotation disk including a plurality of protrusions extending radially and outward therefrom;

a rotation device including a frame and a motor secured to the frame, a transmission device including a shaft, a belt wheel driven by the motor and a belt connected between the belt wheel and the shaft;

a magnetic member connected to the shaft and extending through the central hole in the rotation disk and magnetically connected to the plate, and at least one detection device connected to the frame and the protrusions passing through the detection device.

5. A mechanism for treat choosing game sets, comprising:

a choosing device including at least one treat which is located on a support board, a plate made by magnetic material, a rotation disk including a central hole and a plurality of connection tubes extending from a side of the rotation disk, the connection tubes extending through the plate and connected with the support board, the rotation disk including a plurality of protrusions extending radially and outward therefrom;

a rotation device including a frame which includes a bottom board, a first side panel connected to one side of the bottom board, a second side panel connected to the other side of the bottom board, the first side panel being higher than the second side panel, a rack having a short side and a long side extending two sides thereof, the long side fixed to the second side panel and the short side fixed to the first side panel, a cover having two folding sides on two sides thereof which are rested on the short side and fixed to the long side respectively, a motor secured to an underside of the rack in the frame and having an driving end which extends through the rack;

a transmission device including a shaft, a belt wheel connected to the driving end of the motor and a belt connected between the belt wheel and the shaft;

a magnetic member having a central hole and a radial hole defined radially in a periphery of the magnetic member, the shaft extending through the central hole in the magnetic member and a securing member extending into the radial hole and contacting against the shaft, at least one recess defined in a top thereof and a magnet received in the at least one recess, the magnetic member extending through the central hole in the rotation disk and magnetically connected to the plate, and at least one detection device connected to the frame and the protrusions passing through the detection device.

* * * * *